United States Patent [19]

Yoshikawa et al.

[11] Patent Number: 5,052,513

[45] Date of Patent: Oct. 1, 1991

[54] NOISE REDUCTIVE RESIN MUFFLER FOR EXHAUST SYSTEM IN COMBUSTION ENGINE

[75] Inventors: Hideo Yoshikawa, Tokyo; Katsuyoshi Takeuchi; Masami Shimada, both of Kanagawa; Yoshiharu Awaji, Tokyo; Takashi Ikeda, Tokyo; Shunsaku Mitsuno, Tokyo, all of Japan

[73] Assignees: Showa Denko Kabushiki Kaisha, Tokyo; Yamato Kogyo Company, Limited, Kanagawa, both of Japan

[21] Appl. No.: 125,579

[22] Filed: Nov. 25, 1987

[30] Foreign Application Priority Data

| | | | |
|---|---|---|---|
| Nov. 26, 1986 | [JP] | Japan | 61-281577 |
| Mar. 11, 1987 | [JP] | Japan | 62-55971 |
| Oct. 3, 1987 | [JP] | Japan | 62-250394 |

[51] Int. Cl.[5] ..... F01N 7/16; F01N 1/10; F01N 1/08

[52] U.S. Cl. ..... 181/246; 181/252; 181/272

[58] Field of Search ..... 181/246, 252, 255, 256, 181/272, 282

[56] References Cited

U.S. PATENT DOCUMENTS

| | | | |
|---|---|---|---|
| 3,158,222 | 11/1964 | Richmond | 181/273 |
| 3,187,837 | 6/1965 | Beeching | 181/246 |
| 3,424,270 | 1/1969 | Hartman et al. | 181/290 |
| 3,489,242 | 1/1970 | Gladding et al. | 181/208 |
| 4,213,414 | 7/1980 | Sato et al. | 181/282 X |
| 4,239,091 | 12/1980 | Negrao | 181/246 X |
| 4,458,779 | 7/1984 | Johansson et al. | 181/252 |
| 4,589,516 | 5/1986 | Inoue et al. | 181/272 X |

FOREIGN PATENT DOCUMENTS

| | | |
|---|---|---|
| 1939197 | 2/1971 | Fed. Rep. of Germany . |
| 3243631 | 5/1984 | Fed. Rep. of Germany . |
| 391384 | 9/1965 | Switzerland . |
| 394713 | 12/1965 | Switzerland . |
| 2067664 | 7/1981 | United Kingdom . |
| 2143275 | 2/1985 | United Kingdom . |

OTHER PUBLICATIONS

20th International Symposium on Automative Technology & Automotion, "With Particular Reference to Mechatronics Use of Electronics for Product Design, Testing, Engineering and Reliability", vol. II, May 29–Jun. 2 1989, pp. 1–13.

Yoshikawa et al., "A study on the Muffling Method Using New Materials", SAE Technical Paper, Series, Sep. 11–13, 1989, pp. 51–55.

Yoshikawa et al., "Noise Reduction in Exhaust Piping System by use of Heat-Resistant Epoxide Muffler", Oct. 19–22, 1987 pp. 1–14, SAE Technical Paper Series.

Yoshikawa et al., "Research on Noise Reduction by use of a Hybrid Muffler", SAE Technical Paper Series, Feb. 27–Mar. 3, 1989, pp. 1–11.

*Primary Examiner*—Russell E. Adams
*Assistant Examiner*—Jae N. Noh
*Attorney, Agent, or Firm*—Ronald P. Kananen

[57] ABSTRACT

In order to accomplish the aforementioned and other objects, a resin muffler, according to the invention, is formed of a heat-resistantive synthetic resin having a property of visco-elastic plasticity in a predetermined temperature range. In the visco-elastic temperature range, the motion of the molecular chain segment of the material resin comes to be relaxed to exhibit noise creative pulsating energy dissipation owing to emission as heat energy. Since the resin muffler thus absorbs noise creative energy by dissipation at around the visco-elastic temperature range and transform the energy into the heat energy which may be emitted by radiation.

27 Claims, 7 Drawing Sheets

NOISE REDUCTIVE RESIN MUFFLER FOR EXHAUST SYSTEM IN COMBUSTION ENGINE

BACKGROUND OF THE INVENTION

1. Field of the Invention

The present invention related generally to a muffler for an exhaust system in a combustion engine, such as an automotive internal combustion engine, gas turbine engine, external combustion engine and so forth. More specifically, the invention relates to an exhaust noise reductive resin muffler which can successfully reduce noise level to be created in the exhaust system without degrading exhaust performance and thus without degrading the engine performance.

2. Description of the Background Art

As is well known, a combustion engine, such as automotive internal combustion engine employs an exhaust system for exhausting an exhaust gas created by combustion of air/fuel mixture in an engine combustion chamber. The exhaust gas in the exhaust system pulsates due to variation of pressure in the engine combustion chamber according to engine cycle. Such pulsatile exhaust gas tends to cause pulsatile noise and exhaust stream noise. In order to suppress such pulsatile noise and stream noise, a muffler of silencer is employed in the exhaust system. The muffler or silencer in the engine exhaust system serves for suppressing pulsation of the exhaust gas and make the pressure of the exhaust gas uniform.

Generally, such muffler or silencer is made of a steel or the like. Such metal muffler comprises a metallic hollow muffler body defining an internal space to smoothing pulsating exhaust gas. However, since the peripheral wall of the metal muffler body is substantially rigid and have substantially no pressure absorbing characteristics. Therefore, various proposal in changing the internal design of the muffler have been presented for successfully reducing the exhaust noise level. In general, reduction of noise in the exhaust system by changing design of the internal structure of the muffler may encounter a problem such as increase of back pressure of the exhaust gas at the engine exhaust port or increase of flow resistance against the exhaust gas and consequently a drop in engine performance.

On the other hand, it would be possible to suppress exhaust noise by attaching noise insulative lining on the inner periphery of the muffler. As the noise insulative lining material, asbestos, glass-fiber and so forth can be used. However, such noise insulative lining may creates another problem of polution.

SUMMARY OF THE INVENTION

Therefore, it is an object of the present invention to provide a resin muffler which can reduce exhaust noise without causing degradation of the engine performance.

Another object of the invention is to provide a heat resistant resin which is suitable for forming the exhaust gas reductive resin muffler;

A further object of the invention is to provide a structure of a resin muffler which can protect the resin material from excessively high temperature exhaust gas and maintain the resin at a temperature range optimal for absorbing noise creative pulsatile vibration.

In order to accomplish the aforementioned and other objects, a resin muffler, according to the invention, is formed of a heat-resistant synthetic resin having a property of visco-elastic plasticity in a predetermined temperature range. In the visco-elastic temperature range, the motion of the molecular chain segment of the material resin comes to be relaxed to exhibit noise creative pulsating energy dissipation owing to emission as heat energy.

As set forth, since the resin muffler according to the present invention, thus absorbs noise creative energy by dissipation at around the visco-elastic temperature range and transform the energy into the heat energy which may be emitted by radiation.

In the preferred composition, as one of the examples the synthetic resin material to form the resin muffler of the present invention is a high-molecular resin compound such as cross-linked epoxy resin. More preferably, a hardner, such as acid anhydride or diamine, cure-promoting agent, a filler are added to bisphenol epoxy. The mixture may be heated to harden to where the mixture has appropriate strong cross-linkage structure available to make the resin usable at the temperature conditions of the exhaust system for combustion engine.

According to one aspect of the present invention, a muffler device for an exhaust system of a combustion engine comprises a hollow muffler body defining an internal space communicated with an engine exhaust port via an exhaust pipe and exposed to an atmosphere via a discharge pipe, the muffler body being formed with a synthetic resin compound which has visco-elastic plastisity for disipating noise creative energy of exhaust gas.

The muffler device made of the synthetic resin set forth above changes states from glassy state to visco-elastic state wherein motion of the segment of the resin comes relaxed to dissipate noise creating energy when temperature rises in the vicinity of a glass transition temperature ($T_g$). The resin maintains visco-elasticity suitable for absorbing the noise creating energy for translating into heat energy. When the temperature further rises across the glass transition temperature, state of the resin becomes rubber state.

According to another aspect of the invention, a muffler device for an exhaust system of a combustion engine comprises a hollow muffler body defining an internal space communicated with an engine exhaust port via an exhaust pipe and exposed to an atmosphere via a discharge pipe, the muffler body being formed with a synthetic resin compound which contains of a heat-resistantive synthetic resin material and a hardner and has visco-elastic plastisity for dissipating noise creative energy of exhaust gas, and a heat-protecting layer structure formed on the inner periphery of the muffler body.

By providing the heat-protecting layer structure, the inner periphery of the resin muffler body may not be directly subject to the substantial heat of an exhaust gas and thus can be protected from being influenced by the high temperature heat. In the preferred construction, the heat-protecting layer structure is formed by a material selected among metal, heat resistantive resin, ceramics, glass wool, glass fiber, glass cloth, asbestos cloth, carbon fiber.

On the other hand, the heat resistant resin compound, in the case of thermosetting resin composed of a base material and hardner. The synthetic resin may be further composed of a filler. Also, this resin may further include a cure-promoting agent.

The heat resistantive resin should have a characteristics for changing states depending on the temperature as set forth above. Therefore, the resin material is selected among a thermosetting resin and a thermoplastic resin. Preferably, the thermosetting resin is selected among epoxy resin, phenol resin, silicon resin, unsaturated polyester resin, diallyl phthalate resin, melamine resin, thermosetting poly carbodiimide. On the other hand, the thermoplastic resin may be preferably selected among polyamide resin, polyester resin, polyphenylene sulfide resin, thermoplastic fluorine containing resin, polysulfon resin, poly phnylene ether resin.

In case of the epoxy resin, the base material may be selected among bisphenol F-type epoxy resin, bisphenol A-type epoxy resin, novolac type epoxy resin.

Also in case of epoxy resin, the hardner is selected among acid anhydride, amine system compound, such as aliphatic, aromatic or fatty amine compound and derivative thereof and imidazol, or mixture thereof. The cure-promoting agent is selected among 2,4,6-dimethyl amino phenol (DMP-30), amino imidazole. The synthetic resin further composed of an inorganic material which is selected among mica, silicon oxide, boron nitride, talc, alumina ($Al_2O_3$), beryllia (BeO), cesium oxide ($CeO_7$), magnesia (MgO), quartz ($SiO_2$), titania ($TiO_2$), zirconia ($ZrO_2$), mullite ($3Al_2O_3.2SiO_2$), spinel ($MgO.Al_2O_3$), silicon carbide (Si.C), titanium carbide (TiC), boron carbide ($B_4C$), tungsten carbide (WC), carbon black (C), boron nitride (BN), silicon nitride ($Si_3N$), aluminium titanate ($AlTiO_3$), mica ceramics (muscobite, sericite), sepiolite, pyrophyllite, steatite ($MgO.SiO_2$), forsterite ($2MgO.SiO_2$), zircon ($ZrO_2$, $SiO_2$), cordielite ($2MgO.2Al_2O_3.5SiO_2$), fiber, flocculent or cloth material, such as glass wool, glass fiber, glass cloth, asbestos cloth, and carbon fiber.

According to a further aspect of the invention, a heat-resistant synthetic resin compund suitable for forming a muffler device for a combustion engine including an automotive internal combustion engine, composed of:

a base material selected among thermosetting resins; and a hardner to be added to said base material, said base material and said hardner being so selected as to provide temperature dependent variable state to have a visco-elastic state at a predetermined temperature range in which noise creative energy of an exhaust gas exhausted from said combustion engine is dissipated.

According to a still further aspect of the invention, a method for producing a muffler device for an exhaust system of a combustion engine, which muffler device including a muffler body made of a heat-resistantive synthetic resin, comprising the steps of:

preparing a composition of a base resin material of thermosetting resin and hardner, which composition has temperature dependent variable characteristics to have visco-elastic state in a predetermined temperature range;

performing heat treatment for said composition for obtaining strengthened cross-linkage; and forming said heat-treated composition into a desired configuration of the muffler.

The step for preparing said composition may further include a step of adding an inorganic material and/or a cure-promoting agent.

The heat treatment step is performed by impregnating molten resin composition to a reinforcement core material and heating the resin impregnated core to form a preimpregnation. The forming step is performed by hot-pressing said preimpregnation, by injection molding, by blow molding or casting to form said preimpregnation into desired configuration of muffler.

BRIEF DESCRIPTION OF THE DRAWINGS

The present invention will be understood more fully from the detailed description given herebelow and from the accompanying drawings of the preferred embodiment of the invention, which, however, should not be taken to limit the invention to the specific embodiment but are for explanation and understanding only.

In the drawings.

DESCRIPTION OF THE PREFERRED EMBODIMENT

Figure 1:
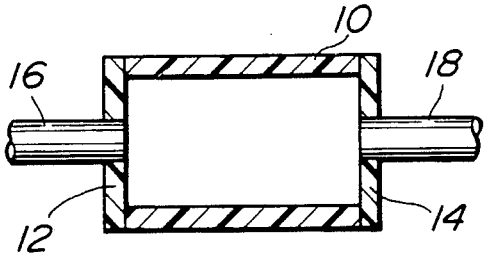
FIG. 1 is a longitudinal section of one of a typical construction of the preferred embodiment of a muffler, according to the present invention.
Figure 2:
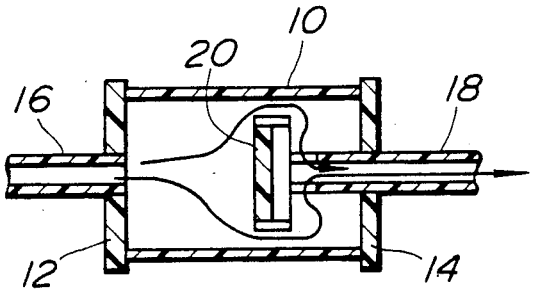
FIG. 2 and 3 are similar longitudinal sections of another constructions of the preferred embodiment of resin mufflers, according to the invention.
Figure 3:
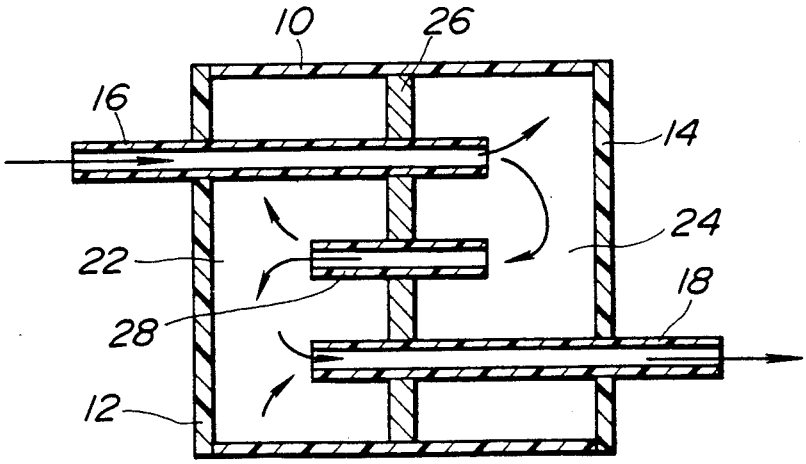

Referring now to the drawings, particularly to FIGS. 1 through 3, there are shown typical constructions of mufflers to be employed in an exhaust system for an automotive internal combustion engine. It should be appreciated that, though the following discussion is concentrated to the preferred embodiment of the muffler which is adapted to be employed in the exhaust system in the automotive engine, the resin muffler or silencer may be applicable for any combustioning energy source which converts heat energy into kinetic energy for driving vehicular wheels, screws of vessels or ships, turbines of aircraft and so forth. Therefore, the following discussion should be appreciated as mere example for implementing noise reductive muffler in such combustioning engine.

FIG. 1 shows one of a typical and the simpliest construction of an automotive muffler. The muffler comprises a muffler body 10 in a hollow cylindrical or hollow box-shaped configuration. The muffler body 10 is formed of a heat-resistant synthetic resin or its composite, material of which will be discussed later. Both axial ends of the muffler body 10 are closed by mirror plates 12 and 14. Through the mirror plate 12, an exhaust pipe 16 which connects an exhaust port (not shown) of an automotive internal combustion engine to the muffler 10, is inserted. On the other hand, a discharge pipe 18 for discharging an exhaust gas to the atmosphere is inserted through the mirror plate 14.

The muffler body 10 has much greater cross-section than the exhaust pipe 16. Therefore, the exhaust gas introduced into the internal space of the muffler body 10 via the exhaust pipe 16 is decelerated and cause decrease of pressure thereof. Similarly, the discharge pipe 18 has smaller cross-sectional path area than the muffler body 10 to limit the exhaust gas flow rate. With such construction, the pulsating magnitude of the exhaust gas to be discharged through the discharge pipe can be structurally reduced.

In the internal structure of FIG. 2, the discharge pipe 18 is extended into the internal space of the muffler body and is integrally formed with a collision plate 20 at its inner end. The collision plate 20 interferes direct flow of the exhaust gas from the exhaust pipe 16 to the discharge pipe 18. So as to receive the exhaust gas, the discharge pipe 18 is formed with one or more openings through the peripheral wall thereof. The collision plate 20 is made of the heat-resistantive synthetic resin or its composit.

With the construction set out above, by the effect of the collision plate, direct flow of the exhaust gas from the exhaust pipe 16 to the discharge pipe 18 can be prevented for expanding the period in which the exhaust gas stays in the internal space of the muffler body 10. In addition, the exhaust gas discharged through the exhaust gas collides onto the collision plate 20 to generate swirl flow in the internal space of the muffler. This assist for regulating the pressure in the internal space and whereby for further reducing the pulsating magnitude of the exhaust gas in the discharge pipe.

In the example of FIG. 3, the internal space of the muffler body divided into first and second chambers 22 and 24, by means of a partition wall 26. The exhaust pipe 16 extends through the mirror plate 12 and across the first chamber 22 to place the inner end thereof within the second chamber 24. On the other hand, the discharge pipe 18 extends across the second chamber 24 and located the inner end within the first chamber 22. The first and second chamber 22 and 24 are communicated by means of a communication pipe 28 extending through the partition wall 26.

With this construction, the exhaust gas flowing through the exhaust pipe 16 is discharged into the second chamber 24. As seen, since the cross-sectional area of the second chamber 24 is much greater than the cross-sectional area of the exhaust pipe 16, the exhaust gas discharged into the second chamber is decelerated and drops the pressure. The exhaust gas in the second chamber 24 flows into the first chamber 22 via the communication pipe 28 and then discharged through the discharge pipe 18.

Similarly to the foregoing example of FIG. 2, the period in which the exhaust gas stays within the internal space of the muffler can be thus expanded to assist regulation of the pressure of the exhaust gas to be discharged through the discharge pipe.

The foregoing constructions of the resin muffler according to the invention is featured by specific, temperature-related features of a heat-resistantive synthetic resin, such as epoxy resin.

In the shown embodiment, the epoxy resin which is specifically developed to replace metal as a material of the muffler, is used as a material for forming the muffler body 10 and the collision plate 20. Such epoxy resin brings about noise reduction by absorbing noise creative energy and, more specifically, reduces the gas stream noise in the muffler and the jet stream noise at the outlet of the discharge pipe. Epoxy resin containing at least two epoxy in a single molecule, is selected. Bisphenol A-type epoxy resin, bisphenol F-type epoxy resin, novolac epoxide resin and so forth are considered as typical epoxide resins to be used for forming the preferred embodiment of the resin muffler.

To the epoxide resin, hardner, cure-promoting agent and filler are added. As a hardner, acid anhydride, such as anhydride methyl nagic acid (MNA), aliphatic, aromatic or fatty amine compound, such as triethylene tetramine, metaphnylene diamine, epomate and so forth and derivative thereof, imidazole, such as 2-ethyl-4-methyl imidazole, are preferred. As a filler, one or more inorganic material, such as mica, silicon oxide, boron nitride, talc is selected.

In preparation, the hardner is, at first, added to the base material of epoxide resin. Therefore, cure-promoting agent is added to the mixture of the base material of epoxide resin and the hardner. Then, the inorganic filler is added. The mixture is then formed into the desired configuration by utilizing a molding dies. Bable removable is then performed by vacuum furnace and thereafter perform heat treatment. Temperature for heat treatment may be variable depending upon the hardner to be used.

For example, when acid anhydride is used as the hardner, heat treatment is performed at about 120° C. for 2 hours and further heated for curing at a temperature about 200° C. for 4 to 8 hours. In the alternative, when fatty amine is used as the hardner, heat treatment is performed at a temperature 30° to 50° for 2 to 3 hours and further heated at about 100° C. for 4 hours for curing. In both case, the formed resin is cooled after curing.

The amount of inorganic material is variable depending upon the kind and particle size of the inorganic material to use. However, the maximum proportion of the inorganic material may be 600 parts by weight for 100 parts by weight of epoxide resin.

Hereafter will discussed about an example of epoxide compound and the resin muffler made of the examplified epoxide compound.

EXAMPLE 1

Figure 4:
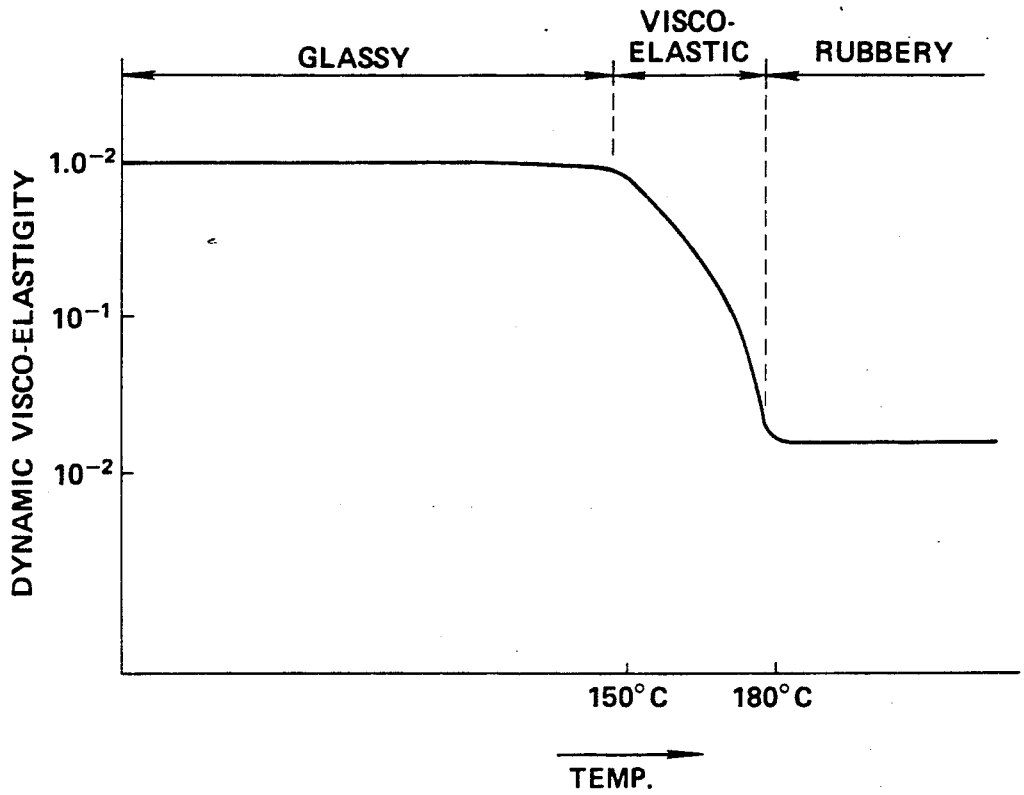
FIG. 4 is a chart showing variation of state of a heat-resistantive resin to form the preferred embodiment of the resin mufflers of the present invention, depending upon the temperature thereof.

In preparation of the sample, Epikote-807 (tradename) available from Shell Chemical K.K. which is bisphenol F-type epoxide compound, is selected. As a hardner, MNA is used. The heat-resistantive epoxide compound prepared with the bisphenol F-type epoxide and MNA has visco-elastic plasticity as shown in FIG. 4. As is seen from FIG. 4, the resin stays in glassy region while the temperature is below about 150° C. In this glassy region, the motion of the molecular chain segment of the resin is frozen. When the temperature becomes higher than about 150° C., the resin enters into visco-elastic region wherein motion of the segment of the resin comes relaxed to dissipate noise creating energy. In the shown example, the resin maintains visco-elasticity suitable for absorbing the noise creating energy for translating into heat energy up to about 180° C. of temperature. When the temperature of the resin becomes higher than about 180° C., the motion of molecular segments becomes free in the rubbery region. At this region, the resin decreases the viscosity in the system and, as a result energy dissipation is decreased.

It should be appreciated that though the glass transition temperature ($T_g$) from the glassy region to the visco-elastic region is specified hereabove with respect to the specific composition of the base resin material and MNA as hardner, it may be variable depending upon the hardner to be mixed with the base resin material and amount of the hardner. Furthermore, it is also possible to adjust the transition temperatures by addition reactive diluent, softening agent and so forth.

As will be appreciated, in the visco-elastic region, the energy to create stream noise, jet noise and so forth can be satisfactorily dissipated by converting into heat energy.

EXAMPLE 2

Variation of the resin characteristics depending upon amount of inorganic material to be added for the mixture of bisphenol F-type epoxide compound, which is Epikoto 807 set forth above and hardner of MNA and 2E4MZ (2-ethyl-4-methyl imidazol), is checked. The result of the experimentation has been shown in the appended table 1.

As will be clear from the table 1, specific gravity, elastisity coefficient and compression strength is increased by increasing amount of the inorganic material.

2E4MZ used as hardner in the sample of resin serves not only as the hardner but also a material for improving heat-resistance of the resin. In order to check the effect of 2E4MZ, thermal deformation temperature was measured for the compound of various composition rate of 2E4MZ. The composition of the resin and corresponding thermal deformation temperature has been shown in the appended table 2.

EXAMPLE 3

Bisphenol F-type epoxide compound, bisphenol A-type epoxide compound, novolac type epoxide compound or mixture thereof is used as to prepare one or more sample resin. To this base material, Epomate LX-1N (tradename) available from AJINOMOTO K. K. and MNA are added to form material resin for forming the preferred embodiment of resin muffler. In the experiments, four samples were prepared with varying composition of the material resins. The composition of the material resins for the four samples were as follows:

| | | |
|---|---|---|
| Sample (1) | Epikoto 807 | 100 parts by weight |
| | Epomate LX-1N | 35 parts by weight |
| Sample (2) | Epikoto 807 | 100 parts by weight |
| | MNA | 90 parts by weight |
| | 2E4MZ | 2 parts by weight |
| Sample (3) | Epikoto 828 | 100 parts by weight |
| | MNA | 80 parts by weight |
| | 2E4MZ | 2 parts by weight |

-continued

| | | |
|---|---|---|
| Sample (4) | Epikoto 154 | 100 parts by weight |
| | MNA | 100 parts by weight |
| | 2E4MZ | 2 parts by weight |

Figure 5:
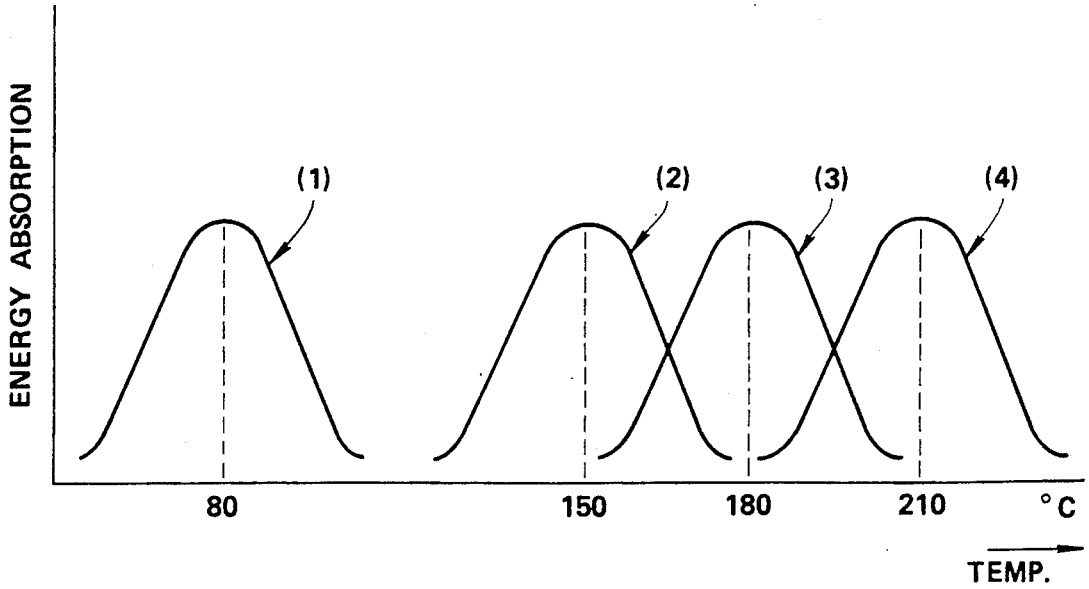
FIG. 5 is a chart showing variation of the noise creative energy absorbing temperature range of various samples prepared in Example 3.

FIG. 5 shows energy absorption range of respective samples (1), (2), (3) and (4). As will be seen from FIG. 5, depending upon the compositions, the temperature dependency of energy dissipation becomes different. Namely, in case of the sample (1), the energy dissipative visco-elastic range was around 80° C. Similarly, respective energy dissipative visco-elastic range of the sample (2), (3) and (4) were around 150° C., 180° C. and 210° C. From this result, it will be appreciated that the temperature of the visco-elastic range rises as increasing the proportion of the hardner in the material resin.

Utilizing the sample (1), the noise level was measured for an air-cooled, single-cylinder four-cycle gasoline engine, specification of which is as follow:

| | |
|---|---|
| Model: | Honda G-200 |
| Stroke Volume | 250 ml × 67DIA × 56 mm. |
| Compression ratio | 6.5 |
| Rated Output | 2.85 Kw (3.8 ps/3600 r.p.m.) |
| Maximum torque | 3.75 Kw (5.0 ps/4000 r.p.m.) |
| Maximum torque | 100 kg-cm/2800 r.p.m. |

In order to compare the performance of the resin muffler made of the material resin of sample (1), the noise level of a metallic muffler as comparative example was also measured. Measurement of the noise level was performed at 2000 r.p.m., 3000 r.p.m. and 4000 r.p.m. respectively. The measured noise levels are shown in the appended table 3. As seen from the result, noise level of the resin muffler is lower than the metallic muffler at all of engine revolution speed range. This proves the higher noise reduction efficiency of the resin muffler than the metallic muffler.

In the experiment, durability of the resin muffler was also tested. Test was performed by driving the engine at 4000 r.p.m. continuously for a long period. After this, the exhaust system was checked and found no abnormality was arisen.

Figure 6:
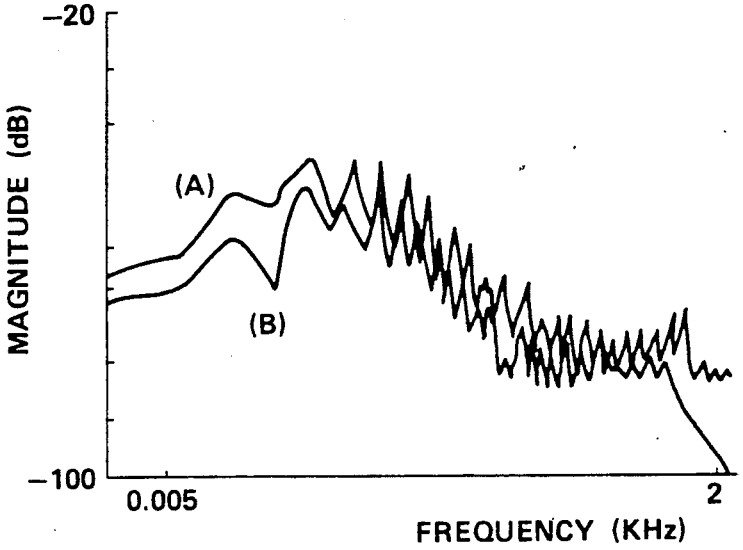
FIG. 6 is a chart showing result of frequency analysis in relatively low engine load condition (2,000 r.p.m. for 2.20 ps)
Figure 7:
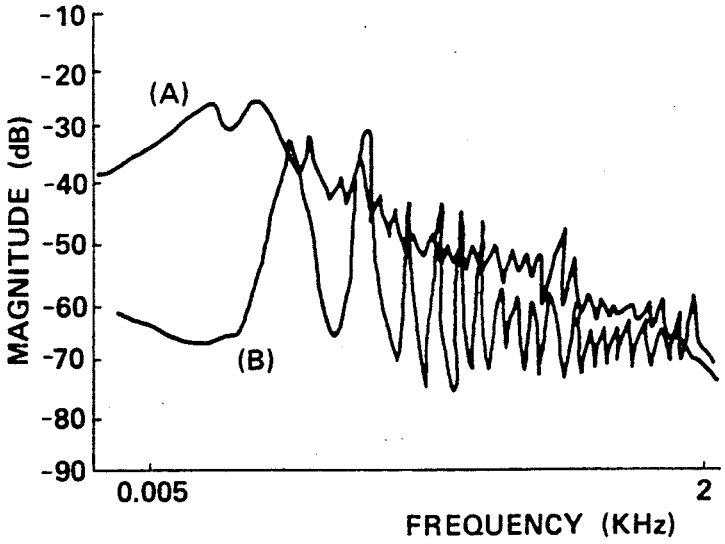
FIG. 7 is a chart showing result of frequency analysis in relatively high engine load condition (4000 r.p.m. for 4.25 ps)

Furthermore, frequency analysis was also performed during experiment. The result of frequency analysis are shown in FIGS. 6 and 7. The result shown in FIG. 6 was obtained at engine speed of 2000 r.p.m. and the result shown in FIG. 7 was obtained at engine speed of 4000 r.p.m. As will be seen by comparing FIGS. 6 and 7, it should be appreciated that noise reduction effect at higher engine load condition becomes greater in comparison with that of the metallic muffler as the comparative example.

EXAMPLE 4

In order to check noise reducing performance of the resin muffler, samples (5) and (6) compositions thereof being shown in the appended table 4 are prepared.

With respect to these samples, noise level was checked utilizing air-cooled, single-cylinder, four cycle gasoline engine. The specification of the engine used in the experiments is same as that set out with respect to that in Example 3.

Figure 8:
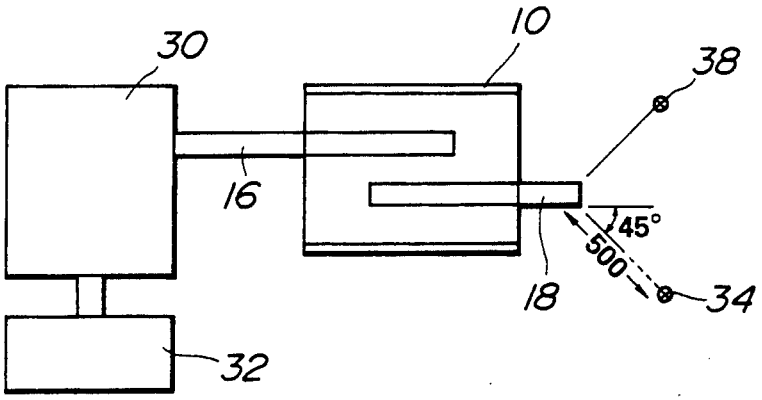
FIGS. 8(A) and 8(B) show test apparatus for performing total noise test, the location of frequency analysis and so forth, which test apparatus was used for performing test for the samples prepared in Example 4.
Figure 8:
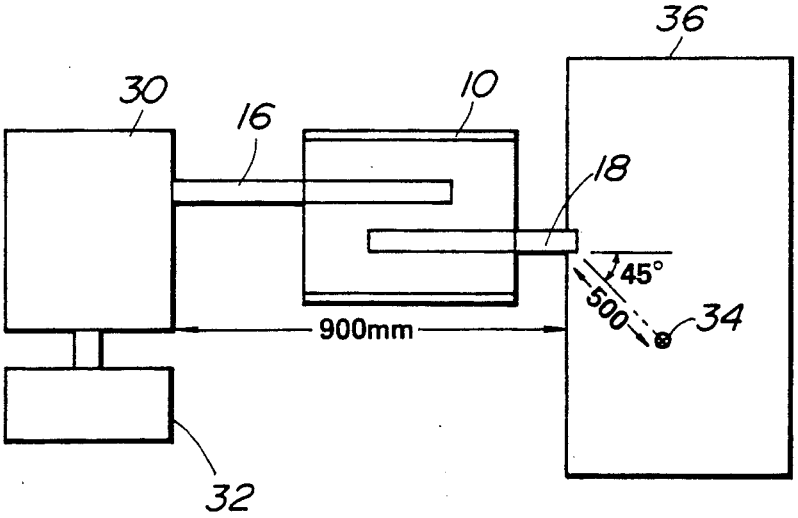

For performing monitoring of noise level, the test apparatus of FIGS. 8(A) and 8(B) are used. As seen from FIGS. 8(A) and 8(B), the muffler 10 was connected to the exhaust port of the engine 30 via the exhaust pipe 16. In order to monitor the engine output, a dynamometer 32 is connected to the engine output shaft. A microphone 34 is provided opposing the outlet of the discharge pipe 18 at an angle of 45° relative to the axis of the discharge pipe.

The test apparatus of FIG. 8(A) was used for monitoring exhaust noise at the discharge pipe outlet direct in the experiment room. On the other hand the apparatus of FIG. 8(B) was used for monitoring the radiant noise from the engine, exhaust pipe, side wall of the muffler and the reflection noise from the wall, floor and ceiling of the experiment room are cut off almost completely by shielded compartment 36. Consequently, the exhaust gas is directly introduced into the shielded compartment for measurement of the exhaust noise along. Therefore, in this case, the microphone 34 is disposed within the shielded compartment.

In either case, the measuring point was set at the same height level as that of the discharge pipe outlet and at a distance of 500 mm from the opposing discharge pipe outlet. In case of the test apparatus of FIG. 8(A), a frequency analyzing microphone 38 is also provided.

In order to compare the noise level to be measured with respect to the preferred embodiment of the resin muffler, a comparative example of a metallic muffler was used for performing measurement of the noise level at the same test condition.

The noise was measured with varying engine speed over 2000 r.p.m. to 4000 r.p.m. by adjusting throttle valve angular positions. During experimental test, engine revolution, output torque, fuel consumption, pressure drop and temperature of exhaust gas at the inlet and at the surface of the muffler body were measured. Also, total noise level was measured with a regular noisemeter which conforms Japanese Industrial Standard (JIS) C 1502 which corresponds to International Standard IEC P. 123 Recommendation for sound-level meter.

For monitoring frequency analysis, the noise was first caught by the condenser microphone and recorded by frequency modulated recording method then re-produced to Fast Fourier Transformation Analysis. The condenser microphone amplifies the differential voltage change of static capacity produced by the bias voltage between the vibration plate and the backside pole caused by sound pressure. 1/1 octave and 1/3 octave band analysis was performed with a combination of a condenser microphone, data recorder, changer amplifier and signal processor. In addition, for reference, a voltage type piezoelectric pick-up was set at the outlet of the exhaust pipe, and the vibration was recorded on cassette tape and reproduced to make the frequency analysis.

The total noise level at the exhaust pipe outlet in the experiment room was measured by the test apparatus of FIG. 8(A). The resultant total noise and the back pressure in the exhaust system measured at each of 2000 r.p.m., 3000 r.p.m. and 4000 r.p.m. for the samples (5) and (6) and comparative metallic muffler, are shown in FIG. 9.

Figure 9:
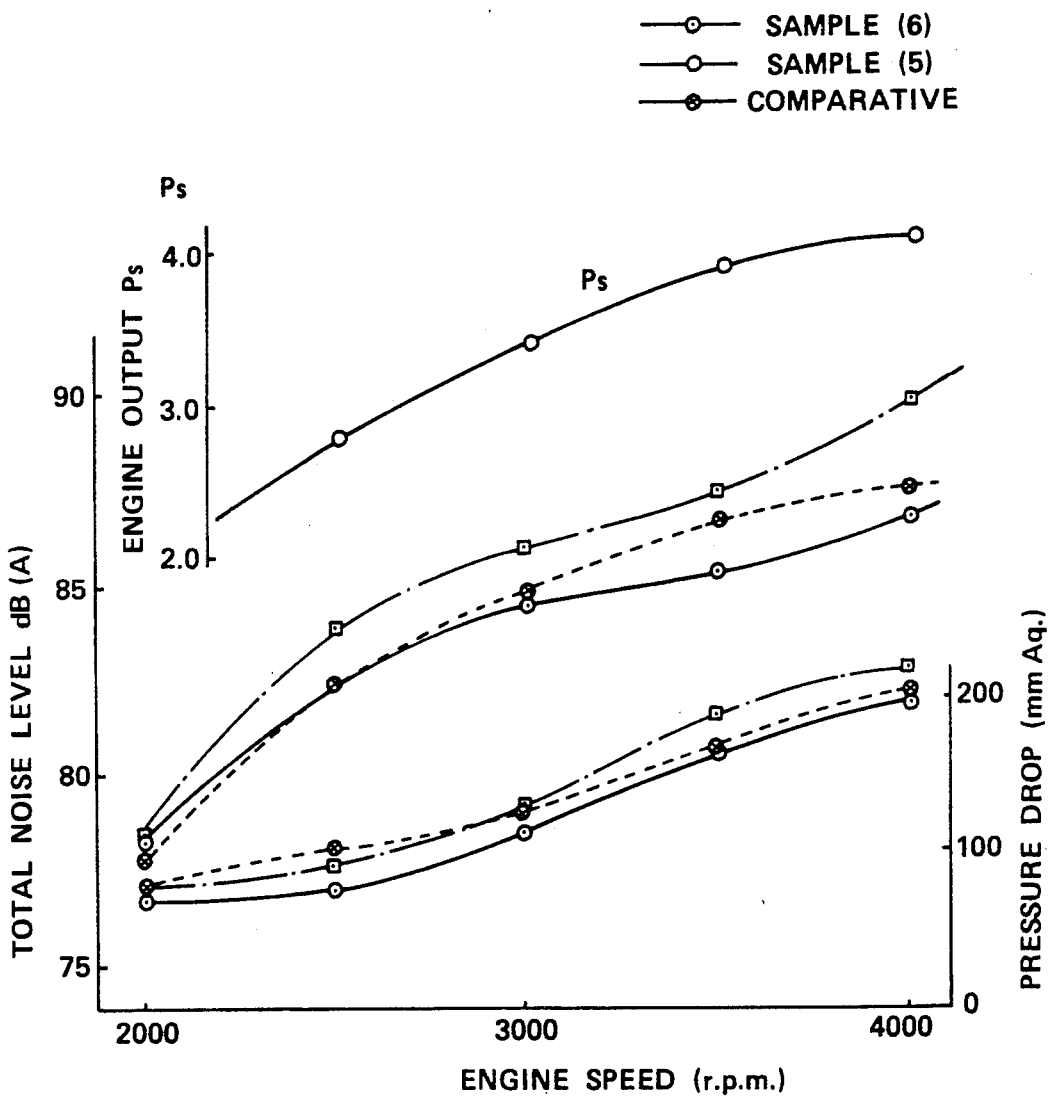
FIG. 9 shows variation of total noise level and back pressure depending upon engine speed as a result of test performed with respect to the samples prepared in Example 4.

As seen from FIG. 9, the sample (6) which has higher glass transition temperature as shown in the table 4, was found to have the highest efficiency in reduction of noise among three samples. Especially, the difference of the noise reduction efficiency at relatively high engine load condition becomes remarkable.

As will be appreciated, the resin muffler, according to the invention, exhibit substantially high noise reduction performance.

In addition, since the synthetic resin has higher corrosion resistance, high anti-corrosion can be obtained by the resin muffler. Furthermore, since noise reduction can reduce the noise by visco-elastisity of the muffler body wall per se, the internal structure of the muffler can be simplified for exhibiting substantially high performance of exhaust system for higher engine performance. Also, since the resin material has substantially smaller specific gravity than the metal for the metallic muffler, weight of the muffler can be significantly reduced.

It should be appreciated that, though the preferred embodiments of the resin muffler, according to the invention, have been disclosed, the material for forming the muffler is not limited to the specific material, i.e. epoxide resin. Since various synthetic resins, which may be heat-resistant resin, can be used. For example, the heat-resistant resin can also be selected among thermosetting resin, such as phenol resin, silicon resin, unsaturated polyester resin, diallyl phthalate resin, melamine resin, thermosetting poly carbodiimide and so forth. The heat-resistant resin can further be selected among thermoplastic resin, such as polyamide resin, polyester resin, polyphenylene sulfide resin, thermoplastic fluorine containing resin, polysulfon resin, poly phenylene ether resin and so forth. The cure-promoting agent and filler can be varied adopting to the base resin material.

Figure 10:
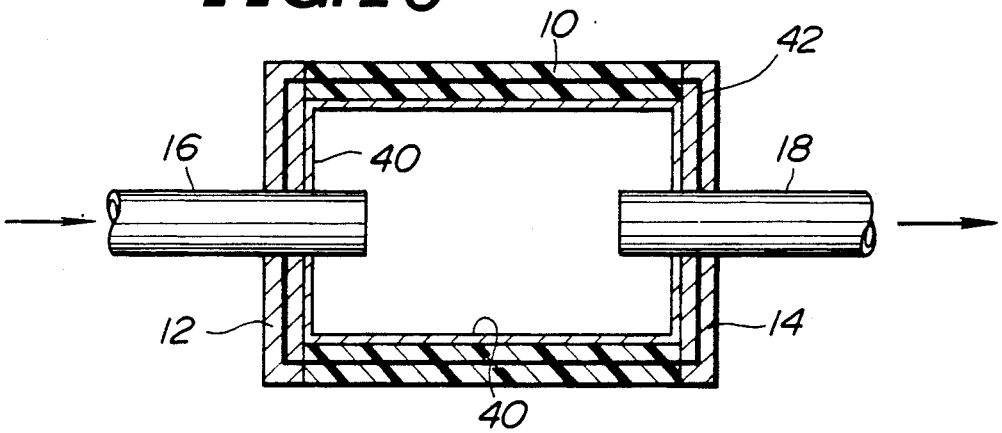
FIG. 10 is a longitudinal section of one of typical construction of another embodiment of a resin muffler according to the invention.
Figure 11:
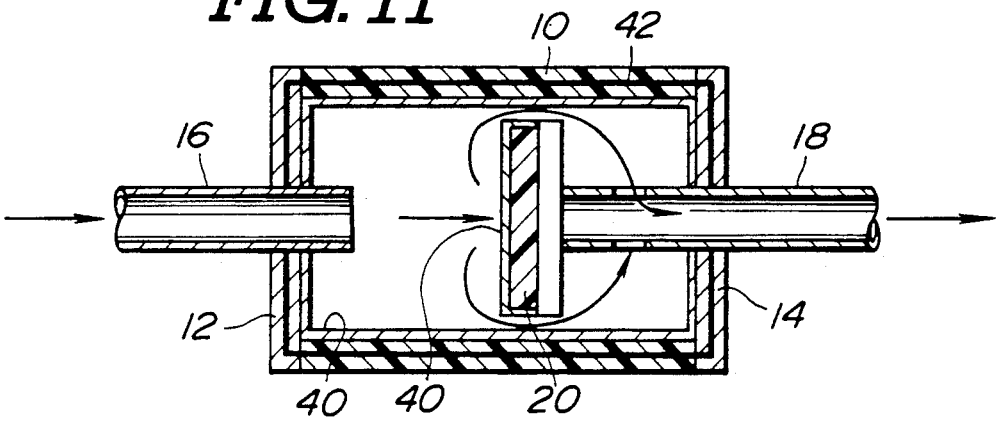
FIGS. 11 and 12 are similar longitudinal section to the foregoing muffler of FIG. 10, but showing variations of constructions of another embodiments of resin mufflers according to the invention.
Figure 12:
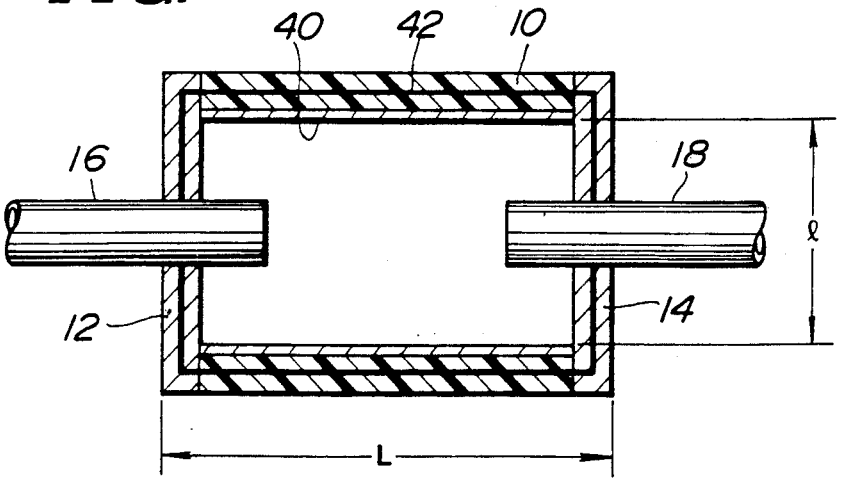

FIGS. 10, 11 and 12 show another embodiments of the resin mufflers according to the present invention. In the following disclosure, the structural element of the embodiments which are common to the former embodiments will be represented by the same reference numerals in order to avoid unnecessary confusion. The detailed discussion about those common structural elements will be neglected in order to simplify the disclosure.

In the shown constructions in FIGS. 10, 11 and 12, the resin mufflers are featured by a heat-protective layer structure 40 formed on the inner periphery of the muffler body 10. The resin mufflers are also featured by reinforcement core 42 molded with the muffler body.

In the shown embodiment, the mirror plates 12 and 14 can be made of the same heat-resistant synthetic resin. In this case, the mirror plates 12 and 14 may be integrally formed with the muffler body 10 by simultaneous forming. Alternatively, the mirror plates 12 and 14 can be made of a heat resistant resin of the different material to that of the muffler body. In this case, the mirror plates 12 and 14 may be formed separately from the muffler body and thereafter bonded or welded on both axial ends of the muffler body. In the further alternative, the mirror plates 12 and 14 may be formed of metallic material, such as copper, carbon steel, stainless steel, aluminium and so forth. In this case, the mirror plates may be fixed onto both ends of the muffler body by any appropriate means.

The reinforcement core may be made of glass cloth, asbestos cloth, carbon fiber and so forth. For the reinforcement core, the material having high heat resistance at high temperature will be suitable to use. Such reinforce core is molded with the synthetic resin so that all of the surface thereof may be covered by the resin for preventing polution.

The synthetic resin as the base material for the resin compound may be selected detecting upon the temperature of the exhaust gas at the muffler. As set forth, the resins to be used as the base material are thermosetting resin and thermoplastic resin. When the exhaust gas temperature is relatively low, e.g. below about 300° C., the thermoplastic resin can be selected. On the other hand, when the exhaust gas temperature is relatively high, e.g. about 300° C. to 400° C., the thermosetting resin is preferred. As a thermoplastic resin, polyamide resin, polyester resin, polyphenylene sulfide resin, thermoplastic fluorine containing resin, polysulfonic resin, poly phenylene ether resin and so forth can be selected. On the other hand, as the thermosetting resin, epoxy resin, phenol resin, silicon resin, unsaturated polyester resin, diallyl phthalate resin, melamine resin, thermosetting poly carbodiimide and so forth, can be selected.

In case of the epoxy resin as the thermosetting resin, addition of epoxy compound containing three or more epoxy in a single morecule, such as phenol-novolac system epoxy resin (Epikote -154 (tradename), available from Shell Chemical K. K.) or N.N.N.N.-tetraglycidylamine system resin, as a sole compound or as a mixture, can improve heat-resistantivity of the material resin for forming the resin muffler. Furthermore, it is effective to use phenol novolac as the hardner.

Similarly to the former embodiment, the compound as the material resin may be prepared by adding hardner, cure-promoting agent and so forth. In addition, as set forth, the inorganic material may be added in a ratio of 30 to 500 parts by weight versus 100 parts by weight of material resin as the compound of the base material, hardner and cure-promoting agent. Such inorganic material may lower the production cost of the material resin and helps improvement of heat radiation characteristics of the muffler. When less than 30 parts by weight of inorganic material is added for 100 parts by weight of the material resin, temperature gradient becomes excessively large to lower heat radiation characteristics. On the other hand, when the amount of the inorganic material is more than 500 parts by weight, forming of the desired muffler configuration becomes difficult. Furthermore, excessive amount of the inorganic material lowers the strength and durability of the formed muffler.

Typical examples of inorganic materials are ceramics, such as alumina ($Al_2O_3$), beryllia (BeO), cesium oxide ($CeO_7$), magnesia (MgO), quartz ($SiO_2$), titania ($TiO_2$), zirconia ($ZrO_2$), mullite ($3Al_2O_3.2SiO_2$), spinel ($MgO.Al_2O_3$), silicon carbide (Si.C), titanium carbide (TiC), boron carbide ($B_4C$), tungsten carbide (WC), carbon black (C), boron nitride (BN), silicon nitride ($Si_3N$), aluminium titanate ($AlTiO_3$), mica ceramics (muscobite, sericite), sepiolite, pyrophyllite, steatite ($MgO.SiO_2$), forsterite ($2MgO.SiO_2$), zircon ($ZrO_2,SiO_2$), cordielite ($2MgO.2Al_2O_3.5SiO_2$), fiber, flocculent or cloth material, such as glass wool, glass fiber, glass cloth, asbestos cloth, and carbon fiber. Though the typical inorganic material are listed hereabove, the any appropriate inorganic materials which are not listed herein can be used. In addition, mixture or compound of two or more inorganic materials can also be used.

The heat-protective layer structure 40 may be formed of a material selected among a metal, such as stainless steel, aluminium, copper, or a heat resistant resin, such as ceramics, glass wool, glass fiber, glass cloth, asbestos cloth, carbon fiber and so forth, for example. Such heat-protective layer structure 40 can be formed simultaneous to forming operation. In case of the metallic heat-protective layer structure, the structure can be formed separately in conformance of the configuration of the inner periphery of the muffler body to be inserted after forming. On the other hand, in case that the heat-protective layer structure is made of the heat-resistant resin in a form of a sheet, the sheet configurated in conformance with the internal configuration of the muffler body may be inserted into the internal space of the muffler body and then fixed in place. In case of the ceramic heat-protective layer structure, lining treatment will be performed for the inner periphery o the muffler body after forming. In addition, ceramic pipe made through high pressure compression molding process can be used for constructing the heat-protective layer structure.

In case of the ceramic heat-protective layer structure, the heat-resistance temperature of the structure will be about 1700° C. to 2500° C. The density of the ceramic layer structure, except for $CeO_2$, WC, is about $\frac{1}{3}$ to $\frac{1}{2}$ of the stainless layer structure. Therefore, by employing ceramics as the material for forming the heat-protective layer structure, the weight of the muffler can be reduced at substantial level.

The muffler body with the reinforcement core and the heat-protective layer structure can be formed in the following process for example. One of the preferred process is to form preimpregnation of glass cloth and thermosetting resin by impregnating thermosetting resin to the glass cloth. The preimpregnation thus formed is pre-heated and put on the metallic heat-protective layer structure 40. Subsequently, the preimpregnation is pressed into the configuration conforming the external configuration of the metallic heat-protective layer structure. On the other hand, in case that the heat-protective layer structure is to be constructed by thin sheet form ceramics, such as ceramic paper of 0.5 mm to 5 mm thick containing silica.alumina as a primary material, the press treatment for the preimpregnation may be performed on an appropriately configurated press die. The ceramic paper is treated by rigidizer and fitted onto the inner periphery of the formed muffler body.

As set forth above, absorption of the noise creative energy becomes optical in the visco-elastic range in the temperature range intermediate of the glassy range and rubbery range. For instance, while the resin temperature is in a range of ±50° C. of the thermal deformation temperature or glass transition temperature, across which the characteristics of the resin changed between visco-elastic range and glassy range. As will be appreciated, since heat resistant resin has lower heat transmission coefficient in comparison with that of the steel plate or stainless steel. Therefore, temperature gradient in the peripheral wall of the muffler body between outside and inside. Namely, at least a portion of the muffler body wall may fall within the visco-elastic temperature range for exhibiting optimal energy absorption characteristics by matching the temperature with the glassy transition temperature.

It should be noted that, in case of the metallic heat-protective layer structure 40 is employed, the thickness of the lining may be of 0.01 mm to 2 mm, more preferably of 0.1 to 2 mm. If the thickness of the layer structure is thicker than 2 mm, weight of the layer structure becomes relatively heavy to interfere formation of the light-weight muffler. On the other hand, if the thickness of the layer structure is less than 0.01 mm, sufficient or satisfactory heat radiation cannot be expected and substantially weaken the strength. On the other hand, when the layer structure is formed by ceramic paper or ceramic sheet, the thickness of 0.5 mm to 5 mm will be required. Further, in case that the muffler body is formed of the inorganic material containing compound, the preferred thickness of the peripheral wall may be 0.1 mm to 10 mm, and further preferably 0.5 to 5 mm. The limit for the maximum thickness, e.g. 10 mm is set in view of formation of the light-weight muffler. On the other hand, thickness of the peripheral wall of the muffler body less than 0.1 mm will have unsatisfactory or insufficient physical strength at high temperature condition.

EXAMPLE 5

For an experiments, the resin muffler having the construction as shown in FIG. 12 was prepared. As a material for forming the heat-protective layer structure 40, a stainless steel of 0.15 mm thick was used. The heat-protective layer structure 40 was formed into a cylindrical configuration with 200 mm of internal diameter (λ) and 300 mm of overall length (L). As a base material for forming the muffler body, a thermosetting resin, i.e. bisphenol F diglycidyl ether (Epikoto-807) was selected. For bisphenol F diglycidyl ether, a harder, i.e. methyl nagic anhydride (Kaya-hard MCD: available from Nippon Kayaku K.K.), a cure-promoting agent, i.e. a mixture of 2-ethyl-4methylimidazole (2E4MZ: available from Shikoku Kasei K.K.) and sericite, were added to form a material resin. The material resin was prepared to have the following composition:

| | |
|---|---|
| bisphenol F diglycidyl ether | 100 g |
| methyl nagic anhydride | 90 g |
| 2-ethyl-4methylimidazol | 2 g |
| sericite | 50 g |

The material resin was impregnated to a glass cloth coated by aminosilane (tradename: available from Nippon Unica K.K.). The glass cloth used in the experiment was of 0.1 mm thick. The material resin impregnated glass cloth was heated at 80° C. for 2 hours for persolidification and thus formed into an epoxy preimpregnation. In the prepared epoxy preimpregnation, content of epoxy resin was 53%.

Around the outer circumference of the metallic heat-protective layer structure, 12 pieces of epoxy preimpregnations were fitted. Hot press, at 2 kg/cm$^2$, 120° C., was performed for the epoxypreimpregnations fitted on the metal layer structure for 12 hours. By this, the muffler body was formed. The peripheral wall thickness of the formed muffler body was 2 mm thick. For this muffler body, the mirror plates made of copper were attached to both axial ends. The exhaust pipe and discharge pipes are inserted through the associated mirror plates. The muffler produced in the process and materials set forth above will be hereafter referred to as "sample 7".

In the similar process, another sample, i.e. sample 8, was prepared. In the same 8, the stainless steel layer structure was replaced with a layer structure made of a ceramic paper, e.g. Fiber Fraz No. 400 which was available from Toshiba Monofrax K.K. and contained alumina.silica as a principle component.

Figure 13:
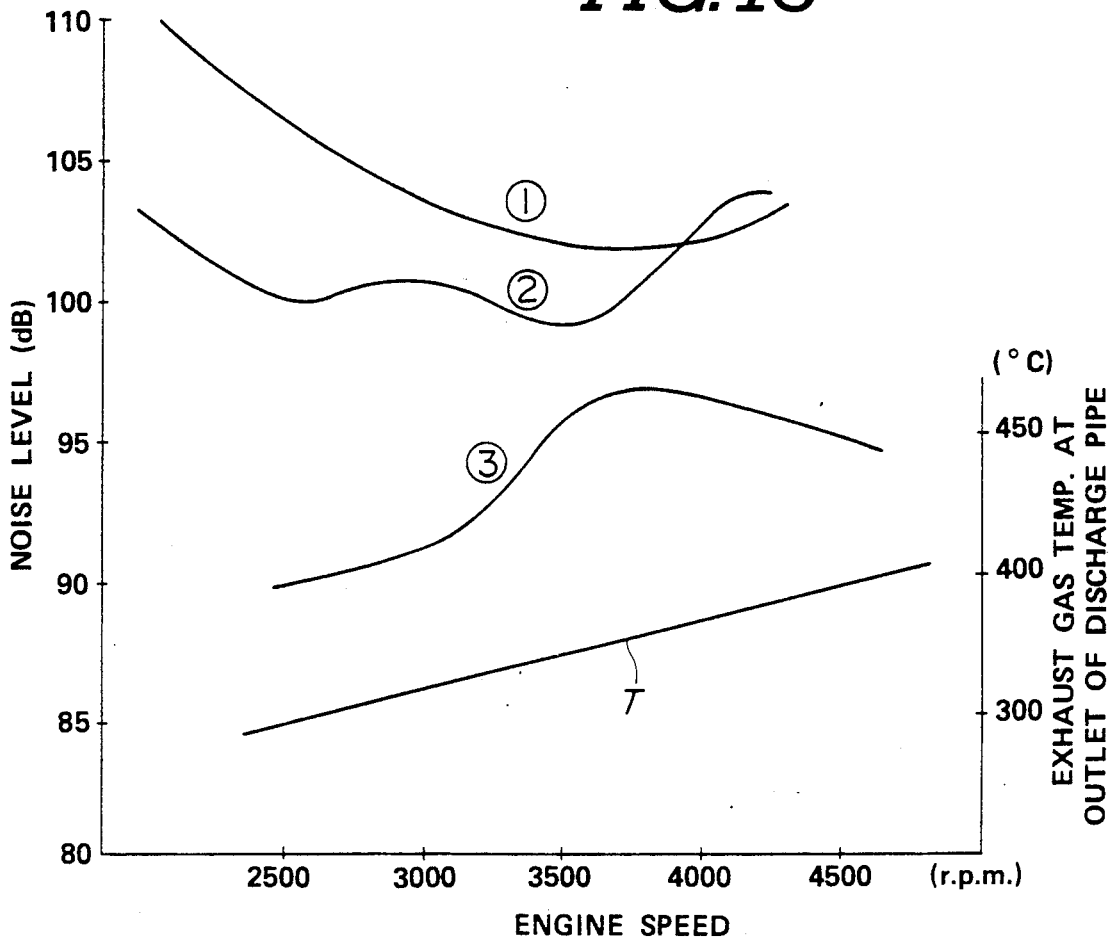
FIG. 13 is a graph showing a result of total noise level test performed with respect to samples prepared in Example 5.

Utilizing the samples 7 and 8, noise reduction performance, test was performed. In order to perform test, water-cooled, 4-cylinder gasoline engine (Nissan E-15, 1500 cc) was used. The samples 7 and 8 were respectively connected to the exhaust system. Exhaust noise level was checked. In order to compare with the noise level of the samples 7 and 8, the noise level of the conventional metallic muffler as a comparative example was checked. The result of the test is shown in FIG. 13. As will be seen from FIG. 13, the noise of the resin mufflers of samples 6 and 7 were found generally lower than that of the metallic muffler. Especially, in case of the sample 7, the noise level was substantially lower than that of the metallic muffler. Namely, in case of the sample 7, the noise level was lower than that of the metallic muffler at a magnitude (noise level) of 10 dB at minimum.

High speed, high load test (4000 r.p.m., 1000 hours) was also performed for checking durability and drop of strength of the mufflers. As a result of test, it was confirmed that no thermal degradation and no drop of strength was observed.

Similar high speed, high load test was performed by directly connecting the mufflers to the engine exhaust without utilizing the exhaust pipe and the discharge pipe. The high speed, high load test was performed at the same condition as the former test with the exhaust pipe and the discharge pipe. After high speed, high load test, it was observed oxidazing degradation on the inner periphery of the muffler body. Furthermore, tensile strength was lowered in the magnitude of ⅓ of that before the test. This result may be considered as an affect of excessively high temperature of the exhaust gas to be introduced into the muffler.

In addition, ⅓ octave band analysis was performed with respect to the noise of the sample 7 and of the conventional metallic muffler. Frequency analysis was performed by Fast Fourier Transformation Analysis. For frequency analysis, the engine was driven at a speed of 4000 r.p.m. The result of the frequency analysis is shown in FIG. 14.

Figure 14:
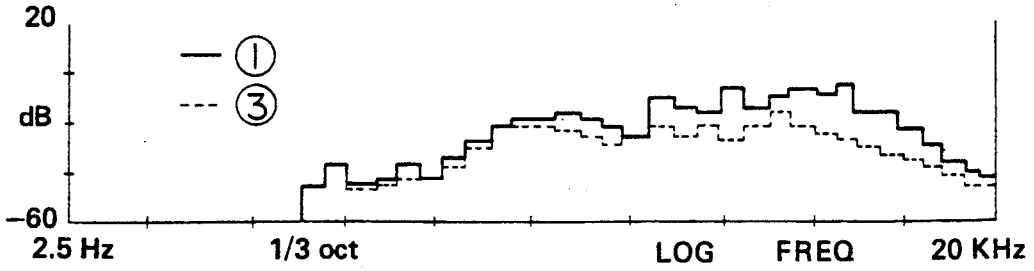
FIG. 14 is a charge showing result of ⅓ octave frequency analysis performed with respect to the samples in Example 5.

As will be seen from FIG. 14, the sample 6 exhibits higher noise creative energy absorption efficiency than that of the conventional metallic muffler. This can be seen from lower level of noise as shown by broken line in FIG. 14. In addition, as will be seen from FIG. 14, the energy absorbing efficiency of the sample 6 is held higher especially in relatively high frequency range.

EXAMPLE 6

As a material for forming the heat- protective layer structure, zirconia ($ZrO_2$) was used. Zirconia powder was mixed with a water glass as a binder and baked at 150° C. for 1 hour and formed into a cylindrical body which has internal diameter of 200 mm, overall length of 300 mm and peripheral wall thickness of 2 mm.

The material resin was prepared from a phenol resin solution prepared by solving resol-type varnish resin (phenol resin, BRS-300 (tradename, available from Showa Kobunshi K. K.) and silica with organic solvent. In preparation, the resol-type varnish resin 100 g versus silica 100 g are solved in the organic solvent.

The phenol resin solution is impregnated to a glass cloth of 0.1 mm thick to form the preimpregnation. In the preimpregnation, the content of resin was 60 Wt%. 16 preimpregnations were fitted onto the outer periphery of the cylindrical body. Then, heat treatment was performed at a pressure of 2 kg/cm$^2$, a temperature of 180° C. and for 1 hour. Form this process, the muffler of the type of FIG. 12 can be prepared. This muffler will be hereafter referred to as "sample 8".

With respect to this sample 8, tests were performed at the same condition to that performed for the samples 6 and 7. Namely, measurement of the total noise level test and high speed, high load test were performed. For performing testing, the engine set out with respect to the foregoing Example 5 was used.

Though the result of the tests are not illustrated on the drawings, the equivalent result to the foregoing samples 6 and 7 could be obtained for this sample 8 in the extent of the total noise level and durability in high speed, high load engine condition.

High speed, high load test was also performed by removing the phenol resin. In this case, oxidizing degradation could be observed on the periphery of the muffler body. This proves that the heat-protective layer structure since no degradation was observed when high speed, high load test was performed for the muffler with the lining.

As will be appreciated herefrom, the present invention fulfills all of the objects and advantages sought therefor.

While the present invention has been disclosed in terms of the preferred embodiment in order to facilitate better understanding of the invention, it should be appreciated that the invention can be embodied in various ways without departing from the principle of the invention. Therefore, the invention should be understood to include all possible embodiments and modifications to the shown embodiments which can be embodied without departing from the principle of the invention set out in the appended claims.

TABLE 1

| E 807 (Wt Parts) P.P.H. | MNA (Wt Parts) P.P.H. | 2E4MZ (Wt Parts) P.P.H. | Inorganic Material (Wt Parts) P.P.H. | Specific gravity (g/ml) | Elasticity Coefficient | Compression Strength (kg/mm$^2$) |
|---|---|---|---|---|---|---|
| 100 | 90 | 2 | Non | 1.24 | 283 | 11.6 |
| 100 | 90 | 2 | 50 Mica | 1.39 | 530 | 15.0 |
| 100 | 90 | 2 | 100 $SiO_2$ | 1.46 | 550 | 17.2 |
| 100 | 90 | 2 | 300 $SiO_2$ | 1.68 | 1000 | 22.2 |

TABLE 2

| P.P.H.: Parts per Hundred | | | | |
|---|---|---|---|---|
| Composition | Epikoto - 807 | 100 | 100 | 100 |
| | M N A (P.P.H.) | 90 | 90 | 90 |
| | 2 E 4 M Z (P.P.H.) | 0.5 | 1 | 2 |
| Thermal Deformation (°C.) | | 136 | 141 | 147 |

(Note) Curing Condition 120° C., 2H + 180° C., 6H

TABLE 3

(UNIT: WEIGHT PARTS PER HUNDRED)

| KIND | EPOXY RESIN | HARDNER | CURING PROMOTING AGENT | FILLER | HDT °C. | TG (°C.) |
|---|---|---|---|---|---|---|
| SAMPLE 5 | 100 | 35 | 0 | 50 | 91.5 | 110 |
| SAMPLE 6 | 100 | 90 | 2 | 50 | 142 | 167 |

TABLE 4

| | | | | |
|---|---|---|---|---|
| Engine Speed rpm | | 2000 | 3000 | 4000 |
| Output PS | | 2.61 | 3.98 | 4.35 |
| Noise | Sample 6 (dB) | 80.5 | 86 | 88.5 |
| | Comparative (dB) | 86 | 93.5 | 96.5 |

What is claimed is:

1. A muffler device for an exhaust system of a combustion engine comprising:

a hollow muffler body defining an internal space;

said muffler body including exhaust means for introducing an exhaust gas from said combustion engine into said internal space and including discharge means for discharging said exhaust gas from said internal space; and said muffler body being formed with a synthetic resin which has visco-elastic plasticity for dissipating noise-creating energy of exhaust gas.

2. A muffler device as set forth in claim 1, wherein said synthetic resin is composed of a heat-resistant thermosetting resin.

3. A muffler device as set forth in claim 1, wherein said synthetic resin is composed of a heat-resistant thermoplastic resin.

4. A muffler device as set forth in claim 2, wherein said synthetic resin is composed of a base material, a hardener and a cure-promoting agent.

5. A muffler device as set forth in claim 1, wherein said synthetic resin compound is selected from the group consisting of a thermosetting resin and a thermoplastic resin, and further composed of a filler.

6. A muffler device as set forth in claim 2, wherein said thermosetting resin is selected from the group consisting of epoxy resin, phenol resin, silicon resin, unsaturated polyester resin, diallyl phthalate resin, melamine resin, thermosetting poly carbodiimide.

7. A muffler device as set forth in claim 3, wherein said thermoplastic resin is selected from the group consisting of polyamide resin, polyester resin, polyphenylene sulfide resin, thermoplastic fluorine containing resin, polysulfon resin, poly phenylene ether resin.

8. A muffler device as set forth in claim 6, wherein said epoxide resin is selected from the group consisting of bisphenol F-type epoxide resin, bisphenol A-type epoxide resin, novolac type epoxide resin.

9. A muffler device as set forth in claim 4, wherein said hardner is selected from the group consisting of acid anhydride, aliphatic, aromatic or fatty amine compound and derivative thereof, and imidazole, or mixture thereof.

10. A muffler device as set forth in claim 4, wherein said cure-promoting agent is selected from the group consisting of 2,4,6-dimethyl amino phenol (DMP-30), dimethyl amino imidazole.

11. A muffler device as set forth in claim 1, wherein said synthetic resin contains an inorganic material.

12. A muffler device as set forth in claim 11, wherein said organic material is selected from the group consisting of mica, silicon oxide, boron nitride, talc, alumina ($Al_2O_3$), beryllia (BeO), cesium oxide ($CeO_7$), magnesia (MgO), quartz ($SiO_2$), titania ($TiO_2$), zirconia ($ZrO_2$), mullite ($3Al_2O_3.2SiO_2$), spinel ($MgO.Al_2O_3$), silicon carbide (Si.C), titanium carbide (TiC), boron carbide ($B_4C$), tungsten carbide (WC), carbon black (C), boron nitride (BN), silicon nitride ($Si_3N$), aluminium titanate ($AlTiO_3$), mica ceramics (muscobite, sericita), sepiolite, pyrophyllite, steatite ($MgO.SiO_2$), forsterite ($2MgO.SiO_2$), zircon ($ZrO_2,SiO_2$), cordielite ($2MgO.2Al_2O_3.5SiO_2$), fiber, flocculent or cloth material, such as glass wool, glass fiber, glass cloth, asbestos cloth, carbon fiber.

13. A muffler device for an exhaust system for a combustion engine comprising:

a hollow muffler body defining an internal space;

said muffler body including exhaust means for introducing an exhaust gas from said combustion engine into said internal space and including discharge means for discharging said exhaust gas from said internal space;

said muffler body being formed with a synthetic resin which contains a heat-resistant synthetic resin material and a hardener and has visco-elastic plasticity for dissipating noise-creating energy of exhaust of exhaust gas; and a heat-protective layer structure formed on an inner periphery of said muffler body.

14. A muffler device as set forth in claim 13, wherein said synthetic resin compound is a compound composed of a heat resistant thermosetting resin.

15. A muffler device as set forth in claim 13, wherein said synthetic resin compound is composed of a heat resistant thermoplastic resin.

16. A muffler device as set forth in claim 14, wherein said synthetic resin is composed of a base material, a hardener and a cure-promoting agent.

17. A muffler device as set forth in claim 13, wherein said synthetic resin compound is selected from the group consisting of a thermosetting resin and a thermoplastic resin, and is further composed of a filler.

18. A muffler device as set forth in claim 14, wherein said thermosetting resin is selected from the group consisting of epoxy resin, phenol resin, silicon resin, unsaturated polyester resin, diallyl phthalate resin, melamine resin, thermosetting poly carbodiimide.

19. A muffler device as set forth in claim 15, wherein said thermoplastic resin is selected from the group consisting of polyamide resin, polyester resin, polyphenylene sulfide resin, thermoplastic fluorine containing resin, polysulfon resin, poly phenylene ether resin.

20. A muffler device as set forth in claim 15, wherein said epoxide resin is selected from the group consisting of bisphenol F-type epoxide resin, bisphenol A-type epoxide resin, novolac type epoxide resin.

21. A muffler device as set forth in claim 16, wherein said hardener is selected from the group consisting of acid anhydride, aliphatic aromatic or fatty amine compound and derivative thereof, and imidazole, or mixture thereof.

22. A muffler device as set forth in claim 16, wherein said cure-promoting agent is selected from the group consisting of 2,4,6-dimethyl amino phenol (DMP-30), dimethyl amino imidazole.

23. A muffler device as set forth in claim 13, wherein said synthetic resin contains an inorganic material.

24. A muffler device as set forth in claim 23, wherein said inorganic material is selected from the group consisting of mica, silicon oxide, boron nitride, talc, alumina ($Al_2O_3$), beryllia (BeO), cesium oxide ($CeO_7$), magnesia (MgO), quartz ($SiO_2$), titania ($TiO_2$), zirconia ($ZrO_2$), mullite ($3Al_2O_3.2SiO_2$), spinel ($MgO.Al_2O_3$), silicon carbide (Si.C), titanium carbide (TiC), boron carbide ($B_4C$), tungsten carbide (WC), carbon black (C), boron nitride (BN), silicon nitride ($Si_3N$), aluminium titanate ($AlTiO_3$), mica ceramics (muscobite, sericite), sepiolite, pyrophyllite, steatite ($MgO.SiO_2$), forsterite ($2MgO.SiO_2$), zircon ($ZrO_2,SiO_2$), cordielite ($2MgO.2Al_2O_3.5SiO_2$), fiber, flocculent or cloth material, such as glass wool, glass fiber, glass cloth, asbestos cloth, carbon fiber.

25. A muffler device as set forth in claim 13, wherein said heat-protective layer structure is formed by a material selected from the group consisting of metal, heat resistant resin, ceramics, glass wool, glass fiber, glass cloth, asbestos cloth, carbon fiber, and inorganic material.

26. A heat-resistant synthetic resin compound suitable for forming a muffler device for a combustion engine including an automotive internal combustion engine, composed of:

a base material selected from a group consisting of thermosetting resins; and a hardener to be added to said base material, said base material and said hardener being so selected as to provide a temperature dependent variable state to have a visco-elastic state at a predetermined temperature range in which noise creative energy of an exhaust gas exhausted from said combustion engine is dissipated.

27. A method for producing a muffler device for an exhaust system of a combustion engine, which muffler device including a muffler body made of a heat-resistant synthetic resin, comprising the steps of:

preparing a composition of a base resin material of a thermosetting resin and hardener, which composition has temperature dependent variable characteristics to have viscoelastic state in a predetermined temperature range;

performing heat treatment for said composition for obtaining strengthened cross-linkage; and forming said heat-treated composition into a desired configuration of the muffler.

28. A muffler device for an exhaust system of a combustion engine comprising:

a hollow muffler body defining an internal space;

said muffler body including exhaust means for introducing an exhaust gas from said combustion engine into said internal space and including discharge means for discharging said exhaust gas from said internal space; and said muffler body being formed of a synthetic resin which has a property to have a visco-elastic plasticity at a temperature range corresponding to a temperature of an exhaust gas introduced into said internal space, for dissipating and absorbing noise-creating energy of exhaust gas.

* * * * *